US006438332B2

(12) United States Patent
Zhao et al.

(10) Patent No.: US 6,438,332 B2
(45) **Date of Patent: *Aug. 20, 2002**

(54) METHOD AND APPARATUS FOR TONER CAKE DELIVERY

(75) Inventors: Weizhong Zhao, Webster; Chu-heng Liu, Penfield, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/725,775

(22) Filed: Nov. 29, 2000

Related U.S. Application Data

(63) Continuation-in-part of application No. 09/536,854, filed on Mar. 28, 2000.

(51) Int. Cl.[7] ..... G03G 15/10
(52) U.S. Cl. ..... 399/57; 399/237
(58) Field of Search ..... 399/57, 237, 240

(56) References Cited

U.S. PATENT DOCUMENTS

| | | | |
|---|---|---|---|
| 4,504,138 A | 3/1985 | Kuehnle et al. | 355/10 |
| 5,436,706 A | 7/1995 | Landa et al. | 355/256 |
| 5,596,396 A | 1/1997 | Landa et al. | 399/237 |
| 5,610,694 A | 3/1997 | Lior et al. | 399/240 |
| 5,619,313 A | 4/1997 | Domoto et al. | 399/233 |

*Primary Examiner*—Quana M. Grainger
(74) *Attorney, Agent, or Firm*—Mark Z. Dudley

(57) ABSTRACT

An imaging system for effecting electrostatic printing of an image, wherein the imaging system includes at least one contact electrostatic printing engine operable in a novel fashion upon a copy substrate, for imaging and development of a latent image representative of the image, and subsequent transfer of the developed image to the copy substrate. The developed image is created by separating and selectively transferring portions of a high solids content secondary toner cake layer in correspondence with the image and non-image regions of the latent image. A toner cake layer delivery apparatus draws from a supply of high solids content liquid developing material to form a primary toner cake layer on a receiving surface of a receiving member. The primary toner cake layer is subject to uniform charging to a first polarity followed by an induced charge of a second, opposing polarity to a selectable depth. The primary toner cake layer is brought into pressure contact at a process nip with an electrically-biased donor surface of movable coating member. Separation of the donor surface and the receiving surface causes the primary toner cake layer to be separated into inner and outer layers. The outer layer is transferred to the donor surface and the inner layer remains on the receiving surface. The inner layer may then be used as the secondary toner cake layer, which features a high solids content, a uniform thickness, and an accurately metered mass per unit area.

23 Claims, 4 Drawing Sheets

METHOD AND APPARATUS FOR TONER CAKE DELIVERY

CROSS-REFERENCE TO RELATED APPLICATION

This application is a continuation-in-part of copending application Ser. No. 09/536,854, filed on Mar. 28, 2000, entitled "Method and Apparatus for Toner Cake Delivery", the content of which is incorporated herein by reference. This application is also related to U.S. patent application Ser. No. 09/457,456, entitled "Method and Apparatus for Delivery of High Solids Content Toner Cake in a Contact Electrostatic Printing System", filed Dec. 8, 1999, in the names of Chu-heng Liu, Weizhong Zhao, and Paul W. Morehouse, Jr., and U.S. patent application Ser. No. 09/525,344, entitled "Toner Cake Delivery System Having a Carrier Fluid Separation Surface", filed Mar. 13, 2000, in the name of Chu-Heng Liu.

FIELD OF THE INVENTION

This invention relates generally to electrostatic latent image development systems that operate using liquid developing material, and, more particularly, relates to a system for electrostatic development of a latent image, wherein the latent image is developed with use of a toner cake layer having a high solids content toner.

BACKGROUND OF THE INVENTION

Various methods of developing a latent image have been described in the art of electrophotographic printing and copying systems. A typical electrostatographic printing process includes a development step whereby a quantity of developing material is physically transported into the vicinity of a latent image bearing imaging member, with the marking particles (described herein as toner) in the developing material are caused to migrate via, e.g., electrical attraction, to the image areas of the latent image so as to selectively adhere to the imaging member in an image-wise configuration.

Of particular interest with respect to the present invention is the concept of forming a thin layer of liquid developing material on a first surface of a first member, wherein the layer has a high concentration of charged toner. The layer on the first member is brought into contact with an electrostatic latent image on a second surface of a second member, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields.

For the purposes of the present description, the concept of latent image development via direct surface-to-surface transfer of a toner layer via image-wise fields will be identified generally as contact electrostatic printing (CEP). Exemplary patents which may describe certain general aspects of contact electrostatic printing, as well as specific apparatus therefor, may be found in U.S. Pat. Nos. 4,504,138; 5,436,706; 5,596,396; 5,610,694; and 5,619,313.

It is desirable that the aforementioned layer of liquid developing material be provided in a very thin and very uniform layer that exhibits a high proportion of solids, that is, having a high solids content. Even more desirable is such a layer exhibiting the following advantageous characteristics: a selectable, uniform thickness, preferably in the range of 3–10 microns; a high solids content, preferably in the range of 15 to 35 percent solids; and an accurately metered mass per unit area on the order of 0.1 mg per $cm^2$.

The intuitive and conventional approach is to attempt the formation of such a layer by direct application of liquid developing material having a high solids content. However, due to the very complicated rheological behavior of a liquid developing material having the requisite high solids content, such direct application of a supply of such liquid developing material to a receiving member typically does not achieve a layer having the aforementioned desirable characteristics. For example, the resulting layer has been found to exhibit a variable thickness and a non-uniform mass per unit area, which renders the layer generally unsuitable for most contact electrostatic printing applications.

SUMMARY OF THE INVENTION

In accordance with one aspect of the present invention, there is provided an imaging system for effecting electrostatic printing of an image, wherein the imaging system includes at least one contact electrostatic printing engine operable in a novel fashion upon a copy substrate, wherein each contact electrostatic printing engine images and develops an electrostatic latent image representative of the image, and subsequently transfers the developed image to the copy substrate.

In accordance with another aspect of the present invention, a toner cake delivery apparatus may be constructed and operated in accordance with the contact electrostatic printing process to which the present invention is directed, wherein a secondary toner cake layer of high solids content and selectable, uniform thickness is created from a primary toner cake layer. This secondary toner cake layer is then highly advantageous for use in development of an electrostatic latent image.

In one embodiment of the present invention, a primary toner cake layer is created on a donor surface of a movable coating member and is subject to uniform charging to a first polarity. Next, the primary toner cake layer is exposed to a charging device whereupon it is subject to an induced charge of a second, opposing polarity to a selectable depth. As a result, the primary toner cake layer exhibits, when considered along its cross-sectional dimension, an inner layer having uniform charge of the first polarity and an outer layer having uniform charge of the second polarity. The primary toner cake layer is brought into pressure contact at a process nip with a receiving surface of movable receiving member. The donor surface and the receiving surface are subject to a electrical bias differential such that the outer layer is subject to a strong attraction to the receiving surface. Due to the bias differential and subsequent separation of the donor surface and the receiving surface, the primary toner cake layer is divided. The outer layer of the primary toner cake layer transfers to the receiving surface of the receiving member and the inner layer of the primary toner cake layer remains on the donor surface. At least one of the inner and outer layers is generally characterized as having a high solids content (e.g., approximately 10–50 percent solids, and preferably in the range of approximately 15 to 35 percent solids, or greater), and exhibits the additional advantageous characteristics of a uniform thickness, in the range of 1–15 microns, and an accurately metered mass per unit area on the order of 0.1 mg per $cm^2$. In a preferred embodiment, the outer layer of the primary toner cake layer is used as the desired secondary toner cake layer, and the inner layer of the primary toner cake layer remains on the donor surface as a residual toner cake layer.

In another embodiment of the present invention, a primary toner cake layer is created on a receiving surface of a receiving member and is subject to uniform charging to a first polarity. Next, the primary toner cake layer is exposed to a charging device whereupon it is subject to an induced charge of a second, opposing polarity to a selectable depth. As a result, the primary toner cake layer exhibits, when considered along its cross-sectional dimension, an inner layer having uniform charge of the first polarity and an outer layer having uniform charge of the second polarity. The primary toner cake layer is brought into pressure contact at a process nip with a donor surface of coating member. The donor surface and the receiving surface are subject to a electrical bias differential such that the outer layer is subject to a strong attraction to the receiving surface. Due to the bias differential and subsequent separation of the donor surface and the receiving surface, the primary toner cake layer is divided. The outer layer of the primary toner cake layer transfers to the donor surface of the coating member so as to form a residual toner cake layer and the inner layer of the primary toner cake layer remains on the receiving surface so as to form a secondary toner cake layer.

In an alternative to the foregoing embodiments, the charging device may be omitted and the applied bias differential is controlled so as to reverse the first polarity charges only to a selectable depth. As a result, the primary toner cake layer exhibits, when considered along its cross-sectional dimension, an inner layer having uniform charge of the first polarity and an outer layer having uniform charge of the second polarity.

In another alternative embodiment, the toner cake delivery apparatus accomplishes the aforementioned uniform charging to a first polarity by use of a supply of high solids content liquid developing material generally made up of toner particles immersed in a liquid carrier material and also typically including a charge director for providing a mechanism for producing an electrochemical reaction in the liquid developing material composition which generates the desired electrical charge on the toner particles. A high solids content liquid developing material applicator provides a relatively uniform, charge layer of high solids content liquid developing material onto the coating member, which may be provided in the form of a drum, web, belt, or similar coating member.

An embodiment of a contact electrostatic printing engine may be constructed to include the aforementioned toner cake layer delivery apparatus and an imaging member for receiving an electrostatic latent image. The imaging member acts as the aforementioned receiving member and thus includes an image bearing surface capable of receiving and supporting the aforementioned secondary toner cake layer. An image-wise exposure device is provided for generating the electrostatic latent image on the imaging member, wherein the electrostatic latent image includes image areas defined by a first charge voltage and non-image areas defined by a second charge voltage distinguishable from the first charge voltage. The aforementioned toner cake delivery apparatus is then employed for depositing the secondary toner cake layer on the image bearing surface of the imaging member so as to form a layer of high solids content that is adjacent the electrostatic latent image on the imaging surface of the imaging member. A separator member is also provided for selectively separating portions of the secondary toner cake layer in accordance with the latent image, to create a developed image corresponding to the electrostatic latent image formed on the imaging member.

BRIEF DESCRIPTION OF THE DRAWINGS

The foregoing and other aspects of the present invention will become apparent from the following description in conjunction with the accompanying drawings wherein like reference numerals have been used throughout to identify identical or similar elements.

DETAILED DESCRIPTION OF THE EMBODIMENTS

The present invention is directed to an electrostatic imaging system wherein latent image development is carried out via direct surface-to-surface transfer of a highly concentrated toner cake layer, utilizing image-wise electrostatic forces to separate the layer of toner cake into image and non-image regions, regardless of where the layer of toner cake is formed prior to image separation or how the image separating electrostatic forces are generated. Although the following description will describe, by example, at least one embodiment of a contact electrostatic printing engine, and related processes that incorporate a photosensitive imaging member, it will be understood that the present invention contemplates the use of various alternative contact electrostatic printing engines and respective imaging members as are known in the art of electrostatographic printing, including, for example, but not limited to, non-photosensitive imaging members such as a dielectric charge retaining member of the type used in ionographic printing machines, or electrode substructures capable of generating charged latent images.

In a principal feature of the invention, the highly concentrated toner cake layer described herein is derived from a supply of high solids content liquid developing material. A primary toner cake layer is presented in the form of a layer of marking material that is supported on a donor surface which is brought into pressure contact with a receiving surface. The primary toner cake layer is separated into an inner layer that remains on the first surface and an outer layer that is transferred as the desired secondary toner cake layer to the receiving surface.

Additionally, the contact electrostatic printing process of the present invention may include development of an electrostatic latent image on an image support using supply limited development techniques, i.e., the developing potential of the latent image is not typically exhausted after being initially developed.

Additionally, the contact electrostatic printing process of the present invention includes limited relative movement between toner particles during and after latent image development, wherein the high solids content of the toner cake layer prevents toner particles from moving relative to each other.

Figure 1:
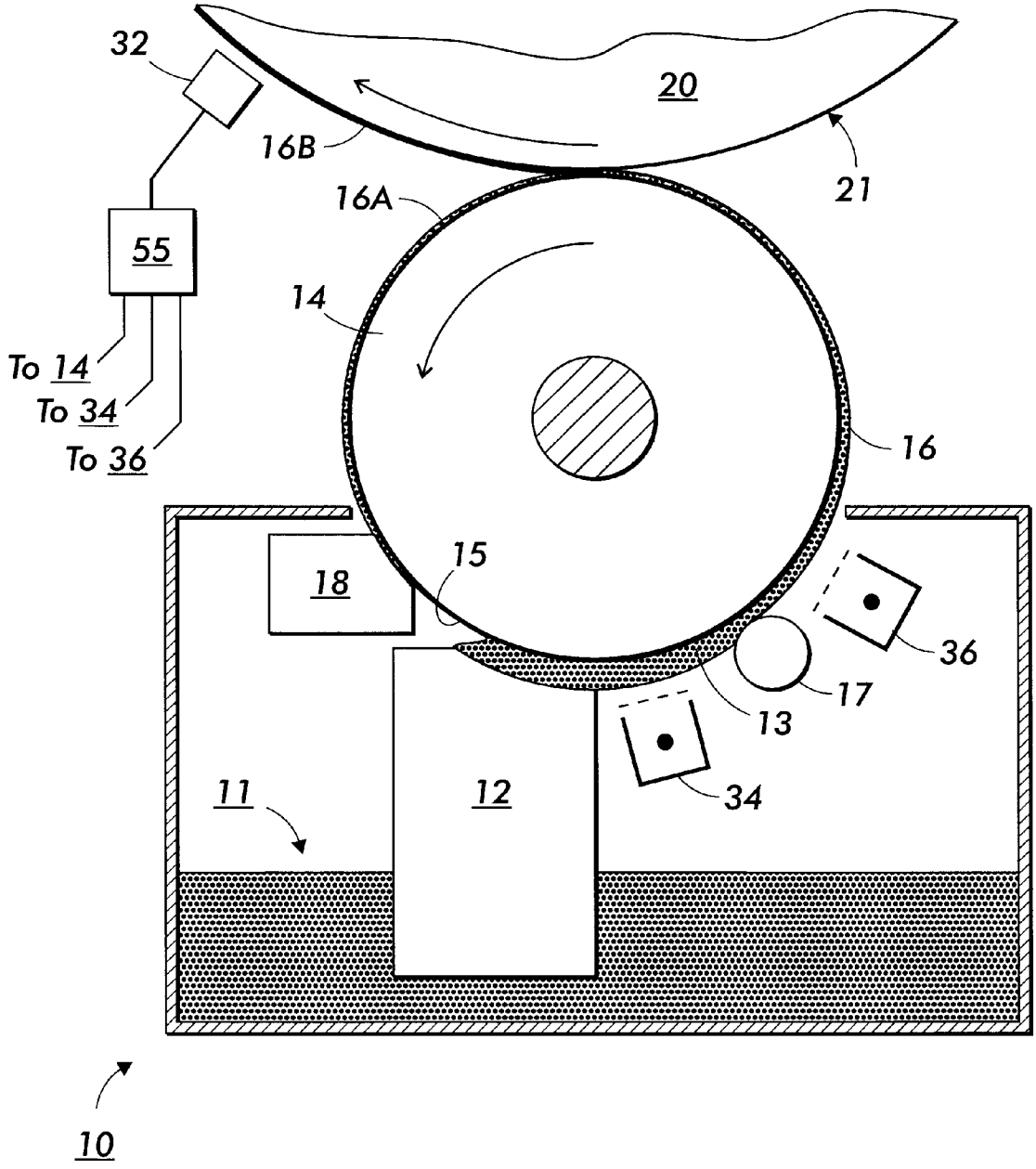
FIG. 1 is a simplified schematic representation of a toner cake layer delivery apparatus constructed according to the present invention for use in a contact electrostatic printing (CEP) system.

FIG. 1 is a simplified schematic representation of a toner cake layer delivery apparatus 10 constructed according to the present invention for use in an electrostatographic imaging system, such as a contact electrostatic printing (CEP) system. The contact electrostatic printing engine may be employed for imaging and developing a electrostatic latent image that corresponds to a desired image, wherein a layer of highly concentrated toner cake is used for development of the latent image, with subsequent separation and transfer of the developed image onto a copy substrate, thereby providing an output image on the copy substrate.

FIG. 1 accordingly illustrates a toner cake layer delivery apparatus 10, wherein a primary toner cake layer of high solids content is created and then split to form a secondary toner cake layer having desirable characteristics for use in image development, such as a consistent, selectable thickness and density. The secondary toner cake layer may be delivered to a suitable latent image bearing imaging member (as will be described below), such that a developed image is created by separating and selectively transferring portions of the secondary toner cake layer in correspondence with the image and non-image regions of the latent image.

The primary and secondary toner cake layers described herein, having a high solids content, may be distinguished from a toner cake layer having low solids content, according to the following criteria. An approximately 1–10 percent solids content is considered to be characteristic of a low solids content toner cake layer; an approximately 10–50 percent solids content, or greater, and preferably on the order of approximately 15 to 35 percent solids, is considered to be characteristic of the desired high solids content toner cake layer. The secondary toner cake layer described herein also preferably exhibits the additional advantageous characteristics of a uniform thickness, selectable from the range of approximately 1–15 microns, and an accurately metered mass per unit area of approximately 0.1 mg per $cm^2$.

The toner cake layer delivery apparatus 10 includes a supply 11 of high solids content liquid developing material from which a high solids content liquid developing material applicator 12 obtains a sufficient amount of high solids content liquid developing material to apply a relatively uniform layer 13 of high solids content liquid developing material onto a donor surface 15 of a movable coating member 14. In the illustrated embodiment, the coating member 14 is provided in the form of a cylindrical roll; however, alternative embodiments include, for example, a movable belt, reciprocating plate, and the like. For the purposes of this description, a high solids content liquid developing material is generally characterized as having a solids content that is on the order of approximately 15 to 35 percent solids.

The toner cake layer delivery apparatus 10 optionally includes a metering device, which, depending on its mode of operation and position with respect to the donor surface 15, may be operated to reduce the high solids content liquid developing material layer 13 to exhibit a selectively metered thickness and thus provide a primary toner cake layer 16. For example, an optional metering roll 17, when situated in close proximity to the donor surface 15, provides a shear force against the high solids content liquid developing material layer 13, thereby providing a controlled thickness of the primary toner cake layer 16. The excess material eventually falls away from the metering roll 17 and may be transported to the supply 11 for reuse.

After application of the high solids content liquid developing material layer 13 to the coating member 14 and concurrent rotation of the coating member 14, the high solids content liquid developing material layer 13 is then subject to charging to a first polarity by a first charging device 34. (Alternatively, if the high solids content liquid developing material is already chemically charged to the first polarity, the charging device 34 may be employed to enhance the desired charge, or simply omitted if further charging is not necessary.) Subsequent engagement with the metering roll 17 adjusts the toner solid concentration of the high solids content liquid developing material layer 13. The thickness of the primary toner cake layer 16 may be considered to be in the range of two to ten times the thickness of the desired secondary toner cake layer; for example, the primary toner cake layer 16 may exhibit a thickness in the range of 6–100 microns.

Next, a second charging device 36 induces, to a selectable depth, a sufficient charge of a second, opposing polarity (i.e., opposite to that of the first polarity) in the primary toner cake layer 16. A power supply and control circuit 55, operable in response to a secondary toner cake layer density sensor 32, determines the appropriate charge levels to be provided by the first and second charging devices 34, 36 as well as a bias voltage provided to the surface 15 of the coating member 14. Suitable embodiments of the sensor 32 include optical density sensors and the like.

Continued rotation of the coating member 14 then brings the primary toner cake layer 16 into engagement with a receiving surface 21 of a receiving member 20. According to the influence of an electrical bias differential between the receiving surface 21 and the donor surface 15, the charge per unit mass in the primary toner cake layer 16, and the distribution of the first and second polarity charges in the primary toner cake layer 16 (one or more of which are established by the power supply and control circuit 55), the primary toner cake layer 16 splits into an outer layer 16B and an inner layer 16A, at least one of which exhibits a controlled, selectable thickness and surface uniformity. Thus, at a consistent and selectable depth of the primary toner cake layer 16, an outer portion of the primary toner cake layer 16 is defined by its strong attraction to the surface 21; this outer portion splits from the remainder of the primary toner cake layer 16 so as to form the outer layer 16B. Meanwhile, the remainder of the primary toner cake layer 16 is strongly attracted to the surface 15 of the coating member 14 in such a way as to form the inner layer 16A on the surface 15 of the coating member 14.

As mentioned, it is contemplated that sufficient electrical bias is applied so as to establish a bias differential between the receiving surface 21 and the donor surface 15. Furthermore, it is contemplated that certain embodiments may employ an electrical bias differential consisting of the combination of a DC voltage and an AC signal. The resulting modulated bias differential fluidizes the portion of the primary toner cake layer 16 present in the gap between the coating member 14 and the receiving member 20, thus enhancing the separation of the inner and outer layers 16A, 16B.

With regard to an alternative to the illustrated embodiment, one may observe that a strong electrical field is present at the gap between the coating member 14 and the receiving member 20; however, the intensity of the electric field decreases according to the radial distance from the receiving member 20. Accordingly, with sufficient control of the selected bias voltage differential and the uniform charge of first polarity established in the primary toner cake layer 16, the illustrated embodiment may be operated without use of the charging device 36. In this alternative mode of operation, the bias voltage differential is selected to penetrate the primary toner cake layer 16 only to a selectable depth, so as to establish the aforementioned inner and outer layers 16A, 16B.

If the high solids content liquid developing material layer 13 is supplied by the supply 11 in a neutral (uncharged) state, the first charging device 34 is operated to charge the layer 13 prior to its transformation to the primary toner cake layer 16. If the high solids content liquid developing material layer 13 is supplied by the supply 11 in a charged state by use of any variety of chemical charging techniques, the first charging device 34 may be omitted, as known in the art. The coating member 14 can be biased using the biasing and control unit 55 to enhance or control the quality of the high solids content liquid developing material layer 13.

Still further rotation of the receiving member 20 and the coating member 14 exposes each of the newly formed inner and outer layers 16A, 16B. In the illustrated embodiment, the outer layer 16B is contemplated as being the most amenable to use as the desired secondary toner cake layer, whereas the inner layer 16A is considered a residual toner cake layer subject to removal from the coating member 14 by a cleaning unit 18. Conservation of some or all of the inner layer 16A thus removed by the cleaning unit 18 is contemplated for subsequent provision to the supply 11.

Alternatively, in an instance wherein the inner layer 16A is used as the desired secondary toner cake layer for image development, continued rotation of the coating member 14 allows the cleaning unit 18 to be employed for removing any remnants of the inner layer 16A situated on the surface 15 after such a development step. In this instance, the outer layer 16B may be similarly removed from the surface 21 by an appropriate cleaning unit (not shown) and conserved, e.g., to replenish the supply 11.

A variety of devices or apparatus may be utilized as the applicator 12 for applying the high solids content material layer 13 to the surface of the coating member 14, such as, but not limited to, known systems directed toward the transportation of liquid developing material having toner particles immersed in a carrier liquid, including various apparatus used in conventional lithographic printing applications as well as traditional liquid electrostatographic applications. For example, the applicator 12 can include a fountain-type device as disclosed generally in commonly assigned U.S. Pat. No. 5,519,473 (incorporated by reference herein). A reverse roll member may also be provided, wherein the function of the reverse roll member can be two-fold: for metering a portion of the liquid carrier away from the liquid developing material as it is applied to the surface of the coating member 14; and/or for electrostatically pushing (via a suitable biasing source, not shown) the liquid developing material toward the surface of the coating member 14. Additionally embodiments of the applicator 12 include the following: a slot die, an extrusion member, a slide, a liquid developing material curtain, a gravure roll, a forward roll, a squeegee roll, a blade apparatus, a foam roller or belt, a wired rod, a screen coater, or a shoe.

One may appreciate that although the coating member 14 of FIG. 1 is shown and described herein in the form of a cylinder, the coating member 14 may alternatively be provided in other forms, such as in the form of a continuous flexible belt.

Figure 2:
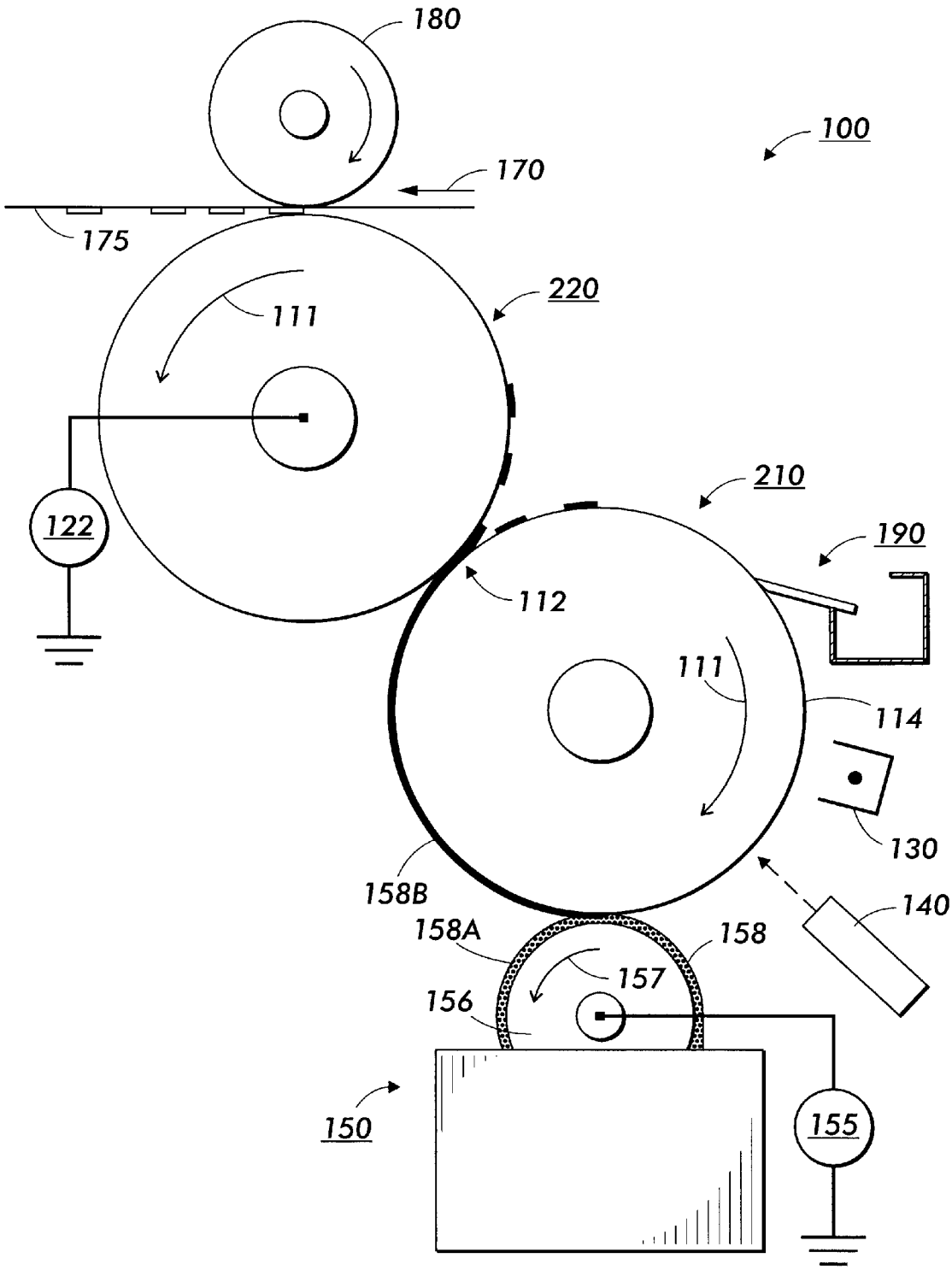
FIG. 2 is an elevational view schematically depicting an embodiment of a CEP engine constructed for imaging and development of an electrostatic latent image.

FIG. 2 is an elevational view schematically depicting a first embodiment of contact electrostatic printing (CEP) engine 100 constructed for imaging and development of a component electrostatic latent image, with advantageous use of a toner cake layer delivery apparatus 150 constructed according to the toner cake delivery apparatus 10 of FIG. 1, wherein a secondary toner cake layer is created and delivered to a latent image-bearing surface for use in development of the latent image.

The illustrated CEP engine 100 is adapted for operation with respect to a copy substrate 175 carried on a substrate transfer path 170. The engine 100 is preferably associated with a respective pressure roller 180 for establishing at least a basic contact transfer, electrostatic transfer, or transfixing of the developed image to the copy substrate 175. An optional fuser assembly (not shown) may be provided for full or final fusing of the developed image when necessary.

The toner cake delivery apparatus 150 delivers a primary toner cake layer 158 to an imaging member 210 whereupon the primary toner cake layer 158 is separated into a secondary toner cake layer 158B and a residual toner cake layer 158A. A nip 112 is created between the imaging member 210 and an image separation member 220, where the secondary toner cake layer 158B, having a high solids content as described hereinabove, is brought into pressure contact with the surface of the image separation member 210, as will be described in detail below, whereupon the secondary toner cake layer 158B is separated into image and non-image segments. Image development occurs as a function of surface-to-surface transfer of an assemblage or aggregate of particles making up a particular section of the secondary toner cake layer as opposed to electrostatic attraction of individual toner particles dispersed in a carrier liquid.

The CEP engine 100 thus comprises a first movable member in the form of the imaging member 210 which includes an imaging surface of any type capable of having an electrostatic latent image formed thereon. An exemplary imaging member 210 may include a typical photoconductor or other photoreceptive component of the type known to those of skill in the art of electrophotography, wherein a surface 114 having photoconductive properties is supported on a conductive support substrate.

Imaging member 210 and image separation member 220 are rotated so as to transport the surfaces thereof in a process direction 111 for implementing a series of image forming steps. (It will be understood that, while imaging member 210 is shown and described herein in the form of a drum, the imaging member may alternatively be provided in the form of a continuous flexible belt which is entrained over a series of rollers, and is movable in the same direction as shown.)

The photoconductive surface 114 of imaging member 210 passes through a charging station, which may include a corona generating device 130 or any other charging apparatus for applying an electrostatic charge to the photoconductive surface 114 of the imaging member 210. The corona generating device 130 is provided for charging the photoconductive surface 114 to a relatively high, substantially uniform electrical charge potential. It will be understood that various charging devices, such as charge rollers, charge brushes and the like, as well as inductive and semiconductive charge devices, among other devices which are well known in the art, may be utilized at the charging station for applying a charge potential to the surface of the imaging member 210.

After the imaging member 210 is brought to a substantially uniform charge potential, the charged photoconductive surface 114 is advanced to an image exposure station, identified generally by reference numeral 140. The image exposure station projects a light image corresponding to the desired component image onto the charged photoconductive surface 114. The light image projected onto the surface of the imaging member 210 selectively dissipates the charge thereon for recording an electrostatic latent image on the photoconductive surface 114, wherein the electrostatic latent image comprises, in image configuration corresponding to the input image information, image areas defined by a first charge voltage potential and non-image areas defined by a second charge voltage potential. The image exposure station 140 may incorporate various optical image projection and formation components as are known in the art, and may include various well known light lens apparatus or digital scanning systems for forming and projecting an image from an original input document onto the imaging member 210. Alternatively, various other electronic devices available in the art may be utilized for generating electronic information to create the electrostatic latent image on the imaging member. It will be understood that the electrostatic latent image may be comprised of image and non-image areas that are defined by regions having opposite charge polarities or by regions having distinguishable first and second voltage potentials which are of the same charge polarity.

The toner cake layer delivery apparatus 150 includes therein a feed line or reservoir adapted to provide a supply of high solids content liquid developing material, generally made up of toner particles immersed in a liquid carrier material and also typically includes a charge director for providing a mechanism for producing an electrochemical reaction in the liquid developing material composition which generates the desired electrical charge on the toner particles.

A coating member 156 is rotated in a direction as indicated by arrow 157 for installing the secondary toner cake layer 158B onto the surface of the imaging member 210. The uniformly distributed secondary toner cake layer 158B is made up of densely packed toner particles in a small percentage of liquid carrier. Depending on the materials utilized in the liquid developing material composition, as well as other process parameters related to the printing system, such as process speed and the like, the desired secondary toner cake layer 158B features a consistent, selectable thickness, preferably between 2 and 15 microns and more preferably on the order of 5 microns or less. A biasing and control unit 155 is coupled to the coating member 156 to assist such controlled formation of the secondary toner cake layer 158.

After the secondary toner cake layer 158B is formed on the imaging member 210, the secondary toner cake layer 158B is brought into pressure contact with the image separation member 220 by transporting the secondary toner cake layer 158B through a process nip 112 formed by the operative engagement of the imaging member 210 and the image separation member 220. The toner cake layer 158B has a solid-like property in the process nip 112 such that the presence of hydrodynamic lift occurring in the nip, as disclosed in some prior art references noted hereinabove, is not applicable to the concepts of the present invention.

One objective of the engine 100 illustrated in FIG. 1 is to place the secondary toner cake layer 158B under pressure in the process nip 112; accordingly, it may desirable to provide either the imaging member 210 or the imaging member 110 in the form of a conformable member for permitting the surface of one member to correspond in form or character to the opposing surface in the nip region. When the imaging member 210 bearing the secondary toner cake layer 158B is engaged with the image separation member 220, the secondary toner cake layer 158B is substantially uniformly distributed within the nip created therebetween such that toner particle motion and/or liquid flow is negligible with no distortion being present or induced between the toner particles in the secondary toner cake layer 158B.

It will be understood that the presence of the latent image on the imaging member 210 may generate some fringe fields in areas of interface between image and non-image areas of the latent image. However, compared to conventional development, the present invention will substantially eliminate fringe field related image defects due to the solid-like property of the secondary toner cake layer 158B at the entrance of the nip.

An electrical biasing source 122 is coupled to the image separation member 220 for applying an electrical bias thereto so as to generate electrostatic fields between the surface of the image separation member 220 and the image or non-image areas on the surface of the imaging member 210. These electrostatic fields generate fields in opposite directions, either toward the surface of the imaging member 210 or towards the surface of the image separation member 220 in accordance with image and non-image portions of the latent image. Moreover, these fields cause the separation of the image and non-image areas of the secondary toner cake layer 158B upon continued rotation of the image separation member 220 and the imaging member 210 at the nip exit, thereby simultaneously separating and developing the secondary toner cake layer 158B into image and non-image portions on the opposed surfaces of the imaging member 210 and the image separation member 220. Development occurs with substantially reduced movement of the toner particles. The development can therefore be implemented at an increased rate to allow high speed processing and improved printing throughput rates. In the illustrated embodiment, the imaging member 210 is provided with an electrical bias appropriate for attracting non-image areas while repelling image areas toward the image separation member 220, thereby maintaining toner portions corresponding to image areas on the surface of the image separation member 220, yielding a developed image on the image separation member 220.

The thickness of the secondary toner cake layer 158B in the process nip 112, and therefore the process nip gap between the imaging member 210 and the image separation member 220, is preferably less than 15 microns and more preferably less than 5 microns. The secondary toner cake layer 158B can have a thickness of about 1 micron and still produce acceptable print quality. A process nip gap of less than 5 microns enables development of images of greater than 800 dots per inch (dpi).

The secondary toner cake layer 158B is exposed to at least two very different and opposed stress forces as it is transported through of the process nip 112. As the secondary toner cake layer 158B enters the process nip 112 and travels therethrough, compressive stress forces are generated and exerted upon the secondary toner cake layer 158B. Thereafter, as the secondary toner cake layer 158B exits the process nip 112 and is separated into image and background areas on the opposed surfaces of the imaging member 210 and the image separation member 220, tensile stress forces are generated and exerted upon the secondary toner cake layer 158B.

Image quality is partially dependent on the ability of the secondary toner cake layer 158B, and in particular, the toner particles therein, to maintain their integrity as an assemblage of toner particles such that lateral movement of the toner particles is prevented when the liquid developing material layer is exposed to compression stress forces, thereby allowing the toner particles to maintain their initial distribution and density levels as the secondary toner cake layer 158B enters the nip 112, and further allowing the toner particles of the liquid developing secondary toner cake layer 158B to sustain an image pattern as it passes through the nip. At the exit, the toner patch in the image area will stay with one surface and the toner patch in the background area will stay with another surface according to the image-wise electrical field. In addition, image quality is further dependent on the ability of the toner particles in the secondary toner cake layer 158B to break sharply along the image-background boundary where the electrostatic force is substantially zero. Thus, it is desired for the secondary toner cake layer 158B to attain a shear tensile yield stress which is substantially lower than the stress induced by the electric fields at the exit of the nip 112 for preventing image quality degradation when the liquid developing material layer is exposed to tensile stress forces at the nip exit while separating into image and non-image regions on opposed surfaces.

The toner particles are required to migrate a relatively small distance, therefore allowing for increased process speeds. The toner particles are generally required to migrate less than one half the width or gap of the process nip 112. As a result of the small toner migration, the image areas and background are interspersed due to each extending from the respective surfaces of the imaging member 110 and imaging member 210 more than one half of the gap of the process nip 112. The thickness of each of the toner layers of the background and the image area are therefore greater than one half the gap of the process nip 112. The spaces in the process nip from which the toner migrates continue to be occupied by carrier fluid. As a result of the relatively small toner migration, the toner layer of the background and the toner layer of the developed image are in substantial contact. As a result, there is edge to edge contact of the opposed toner layers in the process nip 112.

The developed image and background are separated at the exit of the process nip 112. The interspersed and contacting developed image area and background toner layers break or snap cleanly at the edge to edge contact. The clean breaking of the edge to edge contact provides for improved edge definition of the developed image relative to prior development systems.

In the illustrated embodiment, continued rotation of the image separation member 220 allows the developed image to be transferred from the surface of the image separation member 220 to a copy substrate 175 carried on the substrate transfer path 170.

In the above-described embodiments of a CEP engine, the developed image transfer step may be effected via selectable means known in the art, and in some embodiments may be effected in accordance with the registration requirements of a composite color image, such as an electrostatic transfer apparatus including a corona generating device or a biased transfer roll. In yet another alternative, image transfer can be accomplished via surface energy differentials wherein the surface energy between the image and the member supporting the image prior to transfer is lower than the surface energy between the image and the copy substrate, inducing transfer thereto.

A pressure transfer roll system may be employed to tack the developed image to the copy substrate 175; this system may include a heating and/or chemical application device for assisting in the pressure transfer and fixing of the developed image on the copy substrate 175. The developed image may be transferred to a copy substrate 175 via a heated pressure roll 180, whereby pressure and heat are simultaneously applied to the developed image to simultaneously transfer and at least partially fuse (e.g., transfuse) the developed image to the copy substrate 175.

Any background image is removed in preparation for a subsequent imaging cycle. A simple blade cleaning apparatus 190 may be employed as is known in the art. Alternative embodiments may include a brush or roller member for removing toner from the surface on which it resides. The removed toner may be transported to a toner sump or other conservation vessel so that the waste toner can be recycled and used again in subsequent imaging cycles.

Additional details of the construction and operation of the illustrated embodiment of a CEP engine, and of further embodiments of a CEP engine, and variations thereof, may be found in commonly-assigned U.S. Pat. Nos. 5,826,147 and 5,937,243, the disclosures of which are incorporated herein by reference.

The liquid carrier medium utilized in the low solids content developing material may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and N, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

The secondary toner cake layer 158B achieves high enough yield stress to substantially eliminate lateral movement of the toner particles in the secondary toner cake layer 158B when exposed to compression stresses generated at the nip 112, while also having sufficiently low yield stress to permit the toner layer to act as a liquid in the presence of tensile stress forces present in the vicinity of the exit of the nip. Further definition of operational parameters for such optimization of the contact electrostatic printing process, via preselecting materials having a particular yield stress and/or selectively varying the yield stress of a given liquid developing material, may be determined by those skilled in the art so as to preselect the materials making up the liquid developing material, the toner particle concentration of the liquid developing material, and the electrical field strength generated between the biased applicator on one surface and the electrostatic latent image on a second surface.

Exemplary marking material colors in the respective high solids content liquid developing materials are selectable as known in the art, e.g., cyan, magenta, yellow, and black; however, other component colors may be employed. It is contemplated that a contact electrostatic printing system would employ at least one of the illustrated CEP engines. Furthermore, the liquid developing material may be distinguishable according to one or more physical characteristics in addition to, or other than, the color of the marking material, and nonetheless such engines are encompassed by the present invention.

The toner solids, or so-called marking material particles, can comprise any particulate material that is compatible with the liquid carrier medium, such as those contained in the liquid developing materials disclosed in, for example, U.S. Pat. Nos. 3,729,419; 3,841,893; 3,968,044; 4,476,210; 4,707,429; 4,762,764; 4,794,651; and 5,451,483, among others. Preferably, the marking material particles should have an average particle diameter ranging from about 0.2 to about 10 microns, and most preferably between about 0.5 and about 2 microns. The marking material particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like, including, for example Elvax®, and/or Nucrel®, available from E. I. DuPont de Nemours & Co. of Wilmington, Del. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which are incorporated herein by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

As previously indicated, in addition to the liquid carrier vehicle and marking material particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

Figure 3:
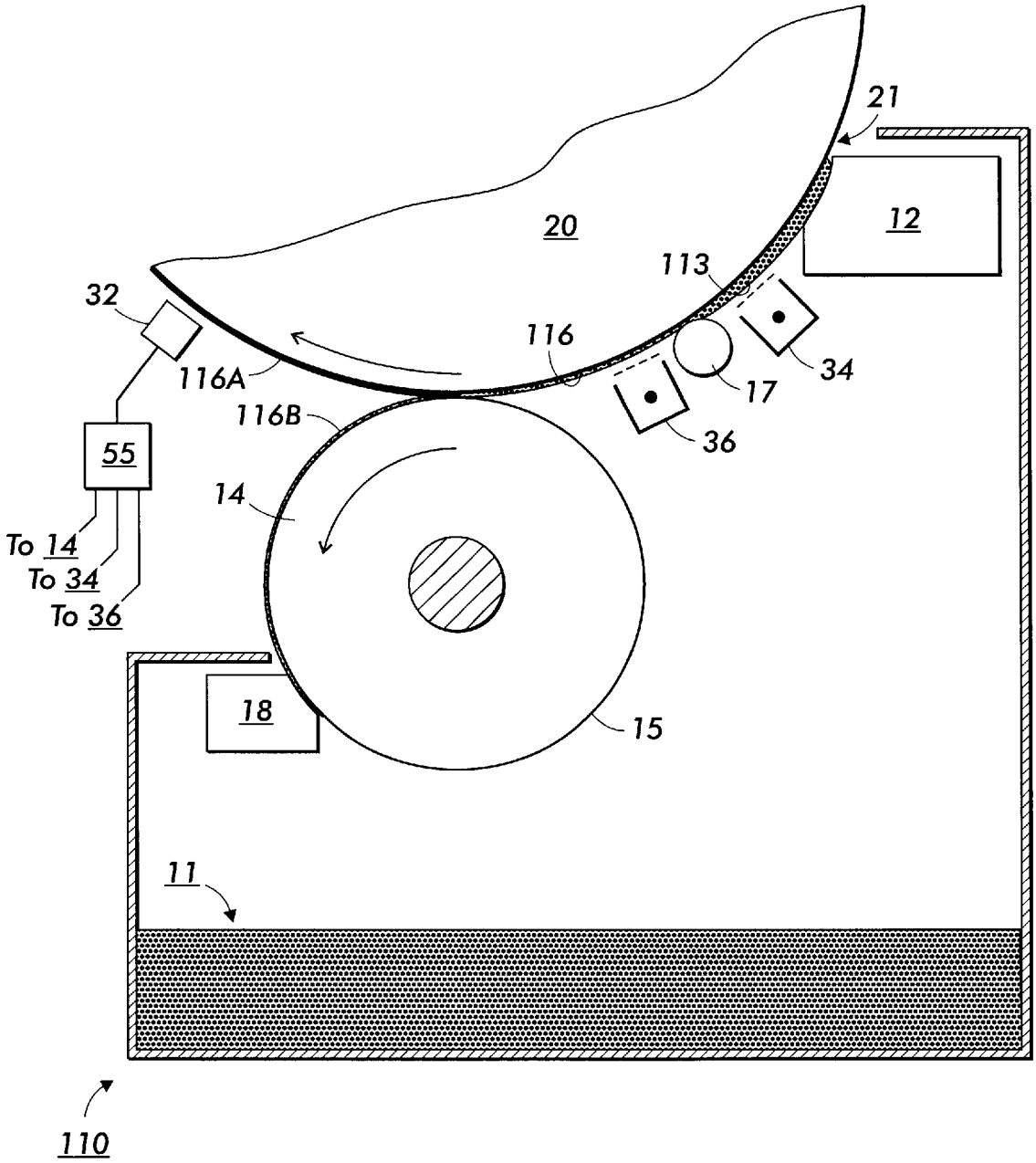
FIG. 3 is a simplified schematic representation of a second embodiment of a toner cake layer delivery apparatus constructed according to the present invention in a contact electrostatic printing (CEP) system.

FIG. 3 illustrates a second embodiment of a toner cake layer delivery apparatus 110, wherein a primary toner cake layer of high solids content is created and then split to form a secondary toner cake layer having desirable characteristics for use in image development, such as a consistent, selectable thickness and density. As will be described with reference to FIG. 4, the secondary toner cake layer is retained on a suitable latent image bearing imaging member, such that a developed image is created by separating and selectively transferring portions of the secondary toner cake layer in correspondence with the image and non-image regions of the latent image.

Turning first to FIG. 3, the contemplated toner cake layer delivery apparatus 110 includes the supply 11 of high solids content liquid developing material from which the high solids content liquid developing material applicator 12 obtains a sufficient amount of high solids content liquid developing material to apply a relatively uniform layer 113 of high solids content liquid developing material onto the receiving surface 21 of the receiving member 20.

The toner cake layer delivery apparatus 110 optionally includes a metering device, which, depending on its mode of operation and position with respect to the receiving surface 21, may be operated to reduce the high solids content liquid developing material layer 113 to exhibit a selectively metered thickness and thus provide a primary toner cake layer 116. For example, the optional metering roll 17, when situated in close proximity to the receiving surface 21, provides a shear force against the high solids content liquid developing material layer 113, thereby providing a controlled thickness of the primary toner cake layer 116. The excess material eventually falls away from the metering roll 17 and may be transported to the supply 11 for reuse.

After application of the high solids content liquid developing material layer 113 to the receiving surface 21 and concurrent rotation of the receiving member 20, the high solids content liquid developing material layer 113 is then subject to charging to a first polarity by the first charging device 34. (Alternatively, if the high solids content liquid developing material is already chemically charged to the first polarity, the charging device 34 may be employed to enhance the desired charge, or simply omitted if further charging is not necessary.) Subsequent engagement with the metering roll 17 adjusts the toner solid concentration of the high solids content liquid developing material layer 13. The thickness of the primary toner cake layer 116 may be considered to be in the range of two to ten times the thickness of the desired secondary toner cake layer; for example, the primary toner cake layer 116 may exhibit a thickness in the range of 6–100 microns.

Next, the second charging device 36 induces, to a selectable depth, a sufficient charge of a second, opposing polarity (i.e., opposite to that of the first polarity) in the primary toner cake layer 116. The power supply and control circuit 55, operable in response to the secondary toner cake layer density sensor 32, determines the appropriate charge levels to be provided by the first and second charging devices 34, 36 as well as a bias voltage provided to the surface 15 of the coating member 14.

Continued rotation of the receiving member 20 then brings the toner cake layer 116 into engagement with the coating member donor surface 15. According to the influence of an electrical bias differential between the receiving surface 21 and the donor surface 15, the charge per unit mass in the primary toner cake layer 16, and the distribution of the first and second polarity charges in the primary toner cake layer 116 (one or more of which are established by the power supply and control circuit 55), the primary toner cake layer 116 splits into an inner layer 116A and an outer layer 116B, at least one of which exhibits a controlled, selectable thickness and surface uniformity. Thus, at a consistent and selectable depth of the primary toner cake layer 116, an outer portion of the primary toner cake layer 116 is defined by its strong attraction to the donor surface 15; this outer portion splits from the remainder of the primary toner cake layer 116 so as to form the outer layer 116B. Meanwhile, the remainder of the primary toner cake layer 116 is strongly attracted to the surface 21 of the receiving member 20 in such a way as to form the inner layer 116A on the surface 21 of the receiving member 20.

As mentioned hereinabove, certain embodiments may employ an electrical bias differential consisting of the combination of a DC voltage and an AC signal. The resulting modulated bias differential fluidizes the portion of the primary toner cake layer 116 present in the gap between the coating member 14 and the receiving member 20, thus enhancing the separation of the inner and outer layers 116A, 116B.

With regard to an alternative to the illustrated embodiment, one may observe that a strong electrical field is present at the gap between the coating member 14 and the receiving member 20; however, the intensity of the electric field decreases according to the radial distance from the receiving member 20. Accordingly, with sufficient control of the selected bias voltage differential and the uniform charge of first polarity established in the primary toner cake layer 116, the illustrated embodiment may be operated without use of the charging device 36. In this alternative mode of operation, the bias voltage differential is selected to penetrate the primary toner cake layer 116 only to a selectable depth, so as to establish the aforementioned inner and outer layers 116A, 116B.

If the high solids content liquid developing material layer 113 is supplied by the supply 11 in a neutral (uncharged) state, the first charging device 34 is operated to charge the layer 113 prior to its transformation to the primary toner cake layer 116. If the high solids content liquid developing material layer 113 is supplied by the supply 11 in a charged state by use of any variety of chemical charging techniques, the first charging device 34 may be omitted. Also, the coating member 14 can be biased using the biasing and control unit 55 to enhance or control the quality of the high solids content liquid developing material layer 113.

Still further rotation of the receiving member 20 and the coating member 14 exposes each of the newly formed inner and outer layers 116A, 116B. In the illustrated embodiment, the inner layer 116A is contemplated as being the most amenable to use as the desired secondary toner cake layer, whereas the outer layer 116B is considered the residual toner cake layer to be removed from the coating member 14 by the cleaning unit 18 for replenishing the supply 11.

Figure 4:
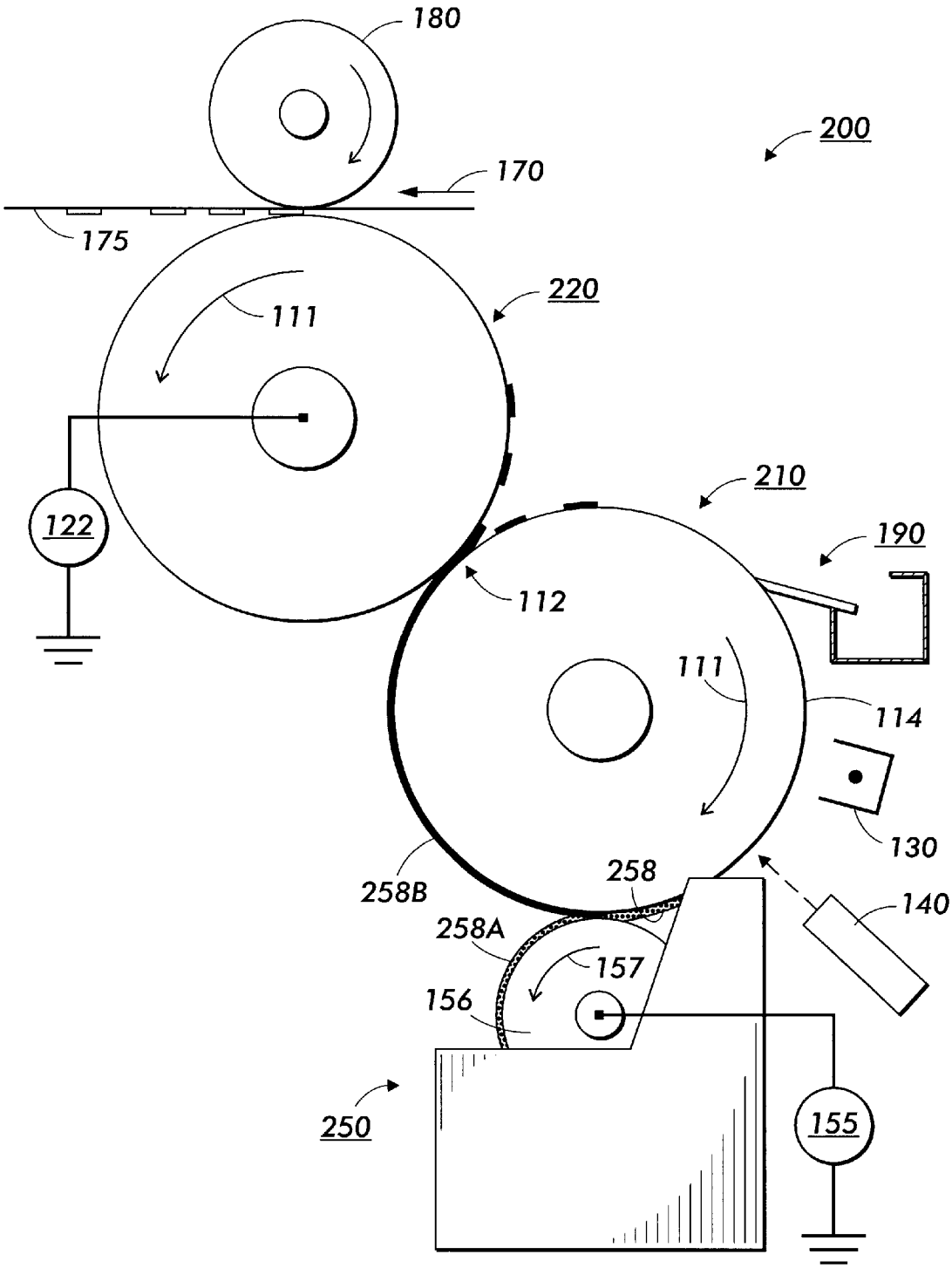
FIG. 4 is an elevational view schematically depicting a second embodiment of a CEP engine constructed for imaging and development of an electrostatic latent image.

FIG. 4 is an elevational view schematically depicting a second embodiment of contact electrostatic printing (CEP) engine 200 constructed for imaging and development of a component electrostatic latent image, with advantageous use of a toner cake layer delivery apparatus 250 constructed according to the toner cake delivery apparatus 110 of FIG. 3. The illustrated CEP engine 200 generally operates as described hereinabove with respect to the CEP engine 100 of FIG. 2 with the exception that the toner cake layer delivery apparatus 250 operates as described with reference to FIG. 3. Hence, a secondary toner cake layer 258A is derived from a primary toner cake layer 258 first deposited on the imaging member 210 as described hereinabove with respect to the primary toner cake layer 116 of FIG. 3. The primary toner cake layer 258 splits into an inner layer thus forming a desired secondary toner cake layer 258A and an outer layer which forms a residual toner cake layer 258B. The secondary toner cake layer 258A is delivered to the imaging member 210 and thereafter to the nip 112 created between the imaging member 210 and the image separation member 220. The secondary toner cake layer 258A, having a high solids content as described hereinabove, is brought into pressure contact with the surface of the image separation member 220, whereupon the developed image and background are separated at the exit of the process nip 112. The interspersed and contacting developed image area and background toner layers break or snap cleanly at the edge to edge contact. Continued rotation of the image separation member 220 allows the developed image to be transferred from the surface of the image separation member 220 to the copy substrate 175 carried on the substrate transfer path 170.

What is claimed is:

1. A method for delivery of a toner cake layer having a high solids content to a receiving surface on a receiving member, comprising the steps of:

providing a supply of high solids content liquid developing material;

receiving a quantity of such liquid developing material and providing therefrom a layer of liquid developing material on a coating member, the coating member having a donor surface for receiving thereon the layer of liquid developing material so as to form a primary toner cake layer;

inducing in at least one of the high solids content liquid developing material and the primary toner cake layer a first induced charge at a first polarity, such that the primary toner cake layer exhibits a uniform charge at the first polarity;

inducing, to a selectable depth, a second induced charge of a second, opposing polarity in the primary toner cake layer, whereby an inner layer of the primary toner cake layer is made subject to the first polarity charge and an outer layer of the primary toner cake layer is made subject to the second polarity charge;

presenting at least a portion of the primary toner cake layer to the receiving surface and inducing a selectable bias differential between the donor surface and the receiving surface, whereby the selectable bias differential causes the inner and outer layers to be respectively attracted to the donor surface and receiving surface; and separating the donor surface and the receiving surface so as to cause the outer layer to be transferred to the receiving surface as a secondary toner cake layer, while the inner layer remains on the donor surface.

2. The method of claim 1, wherein the high solids content liquid developing material is characterized as having percentage level of solids content in the range of more than approximately 10 percent solids content.

3. The method of claim 1, wherein at least one of the inner and outer layers is characterized as having at least one of the following characteristics: a percentage level of solids content of approximately 10 percent solids content or greater; a uniform thickness in the range of 1 to 15 microns; and an accurately metered mass per unit area of approximately 0.1 mg per $cm^2$.

4. The method of claim 1, further comprising the steps of:

controlling at least one of said first induced charge, second induced charge, and bias differential; and in response to such controlling, inducing the second induced charge of the opposing polarity to the selectable depth in the primary toner cake layer.

5. The method of claim 1, further comprising the step of establishing a selectable bias differential having a combination of a DC voltage and AC signal, whereby the portion of the primary toner cake layer presented to the receiving surface is fluidized.

6. The method of claim 1, further comprising the steps of:

determining the density of at least one of the inner and outer layers and, in response, altering the depth of the secondary toner cake layer.

7. A method for delivery of a toner cake layer having a high solids content to a receiving surface on a receiving member, comprising the steps of:

providing a supply of high solids content liquid developing material;

receiving a quantity of such liquid developing material and providing therefrom a layer of liquid developing material on the receiving surface so as to form a primary toner cake layer;

inducing in at least one of the high solids content liquid developing material and the primary toner cake layer a first induced charge at a first polarity, such that the primary toner cake layer exhibits a uniform charge at the first polarity;

inducing, to a selectable depth, a second induced charge of a second, opposing polarity in the primary toner cake layer, whereby an inner layer of the primary toner cake layer is made subject to the first polarity charge and an outer layer of the primary toner cake layer is made subject to the second polarity charge;

presenting at least a portion of the primary toner cake layer to the donor surface of a coating member and inducing a selectable bias differential between the donor surface and the receiving surface so as to cause the inner and outer layers to be respectively attracted to the receiving surface and the donor surface; and separating the donor surface and the receiving surface so as to cause the outer layer to be transferred to the donor surface while the inner layer remains on the receiving surface as a secondary toner cake layer.

8. The method of claim 7, wherein the high solids content liquid developing material is characterized as having percentage level of solids content in the range of more than approximately 10 percent solids content.

9. The method of claim 7, wherein at least one of the inner and outer layers is characterized as having at least one of the following characteristics: a percentage level of solids content of approximately 10 percent solids content or greater; a uniform thickness in the range of 1 to 15 microns; and an accurately metered mass per unit area of approximately 0.1 mg per $cm^2$.

10. The method of claim 7, further comprising the steps of:

controlling at least one of said first induced charge, second induced charge, and bias differential; and in response to such controlling, inducing the second induced charge of the opposing polarity to the selectable depth in the primary toner cake layer.

11. The method of claim 7, further comprising the step of establishing a selectable bias differential having a combination of a DC voltage and AC signal, whereby the portion of the primary toner cake layer presented to the donor surface is fluidized.

12. The method of claim 7, further comprising the steps of:

determining the density of at least one of the inner and outer layers and, in response, altering the depth of the secondary toner cake layer.

13. A toner cake layer delivery apparatus for delivery of a toner cake layer having a high solids content to a receiving surface on a receiving member, comprising:

a movable coating member aligned with the receiving member;

a supply of high solids content liquid developing material;

a liquid developing material applicator connected to the supply of high solids content liquid developing material and operable for receiving a quantity of such liquid developing material and for providing therefrom a layer of liquid developing material on the receiving surface so as to form a primary toner cake layer;

first charge inducing means for inducing in at least one of the high solids content liquid developing material and the primary toner cake layer a first induced charge at a first polarity, such that the primary toner cake layer exhibits a uniform charge at the first polarity;

second charge inducing means for inducing, to a selectable depth, a second induced charge of a second, opposing polarity in the primary toner cake layer, whereby an inner layer of the primary toner cake layer is made subject to the first polarity charge and an outer layer of the primary toner cake layer is made subject to the second polarity charge; and means for inducing a selectable bias differential between the donor surface and the receiving surface;

wherein the receiving member is operable for presenting at least a portion of the primary toner cake layer to the donor surface and wherein the selectable bias differential causes the inner and outer layers to be respectively attracted to the receiving surface and donor surface, such that subsequent separation of the donor surface and the receiving surface causes the outer layer to be transferred to the donor surface while the inner layer remains on the receiving surface as a secondary toner cake layer.

14. The apparatus of claim 13, wherein the high solids content liquid developing material is characterized as having percentage level of solids content in the range of more than approximately 10 percent solids content.

15. The apparatus of claim 13, wherein at least one of the inner and outer layers is characterized as having at least one of the following characteristics: a percentage level of solids content of approximately 10 percent solids content or greater; a uniform thickness in the range of 1 to 15 microns; and an accurately metered mass per unit area of approximately 0.1 mg per $cm^2$.

16. The apparatus of claim 13, further comprising a control means for controlling at least one of said first induced charge, second induced charge, and bias differential.

17. The apparatus of claim 16, further comprising a sensor for determining the density of at least one of the inner and outer layers and for providing a respective output signal, and wherein the operation of the control means is responsive to the output signal.

18. The apparatus of claim 13, wherein the second charge inducing means provides an electrical field that penetrates the primary toner cake layer to a depth corresponding to the thickness of the outer layer, thereby establishing said second induced charge of an opposing polarity in the primary toner cake layer.

19. The apparatus of claim 13, further comprising means for establishing a selectable bias differential having a combination of a DC voltage and AC signal, whereby the portion of the primary toner cake layer presented to the receiving surface is fluidized.

20. An imaging system for effecting contact electrostatic printing of an output image, comprising:

an imaging assembly having an imaging member, the imaging member having a receiving surface for receiving an electrostatic latent image thereon, the electrostatic latent image being representative of the desired output image;

a toner cake layer delivery apparatus for delivery of a toner cake layer having a high solids content to the receiving surface on the imaging member, comprising:

a supply of high solids content liquid developing material;

a liquid developing material applicator connected to the supply of high solids content liquid developing material and operable for receiving a quantity of such liquid developing material and for providing therefrom a layer of liquid developing material on the receiving surface so as to form a primary toner cake layer;

a coating member aligned with the liquid developing material applicator and the receiving member, the coating member having a donor surface, the movable coating member being operable for pressure contact at a process nip with the receiving surface;

first charge inducing means for inducing in at least one of the high solids content liquid developing material and the primary toner cake layer a first induced charge at a first polarity, such that the primary toner cake layer receives a uniform charge at the first polarity; and second charge inducing means for inducing, to a selectable depth, a second induced charge of a second, opposing polarity in the primary toner cake layer, whereby an inner layer of the primary toner cake layer is made subject to the first polarity charge and an outer layer of the primary toner cake layer is made subject to the second polarity charge; and means for inducing a selectable bias differential between the donor surface and the receiving surface;

wherein the receiving member is operable for presenting at least a portion of the primary toner cake layer to the donor surface and wherein the selectable bias differential causes the inner and outer layers to be respectively attracted to the receiving surface and donor surface, such that subsequent separation of the donor surface and the receiving surface causes the outer layer to be transferred to the donor surface while the inner layer remains on the receiving surface.

21. The imaging system of claim 20, wherein the receiving surface further comprises a photosensitive imaging substrate.

22. The imaging system of claim 20, wherein the high solids content liquid developing material is characterized as having percentage level of solids content in the range of more than approximately 10 percent solids content.

23. The imaging system of claim 20, wherein at least one of the inner and outer layers is characterized as having at least one of the following characteristics: a percentage level of solids content of approximately 10 percent solids content or greater; a uniform thickness in the range of 1 to 15 microns; and an accurately metered mass per unit area of approximately 0.1 mg per $cm^2$.

* * * * *